US006637978B1

(12) United States Patent
Genta

(10) Patent No.: US 6,637,978 B1
(45) Date of Patent: Oct. 28, 2003

(54) METHOD AND A WORKING MACHINE FOR THE LAYING CABLE, PIPES OR THE LIKE

(75) Inventor: Ivo Genta, Nucetto (IT)

(73) Assignee: Alpitel S.p.A., Nucetto (IT)

( * ) Notice: Subject to any disclaimer, the term of this patent is extended or adjusted under 35 U.S.C. 154(b) by 0 days.

(21) Appl. No.: 10/069,059

(22) PCT Filed: Sep. 4, 2000

(86) PCT No.: PCT/EP00/08607

§ 371 (c)(1),
(2), (4) Date: Feb. 19, 2002

(87) PCT Pub. No.: WO01/23677

PCT Pub. Date: Apr. 5, 2001

(30) Foreign Application Priority Data

Sep. 28, 1999 (IT) ..... TO99A0829

(51) Int. Cl.[7] ..... F16L 1/028
(52) U.S. Cl. ..... 405/174; 405/180
(58) Field of Search ..... 405/174, 175, 405/176, 177, 178, 179, 180, 181, 182, 183

(56) References Cited

U.S. PATENT DOCUMENTS 4,812,078 A 3/1989 Rivard
5,452,969 A * 9/1995 Crook ..... 405/303
5,913,638 A * 6/1999 Lansdale ..... 405/179
6,189,244 B1 * 2/2001 Johnson et al. ..... 37/349

FOREIGN PATENT DOCUMENTS

| | | |
|---|---|---|
| CH | 653 725 | 1/1986 |
| EP | 0 162 623 | 11/1985 |
| FR | 2 714 091 | 6/1995 |
| FR | 2 750 717 | 1/1998 |
| FR | 2 773 565 | 7/1999 |

* cited by examiner

*Primary Examiner*—Heather Shackelford
*Assistant Examiner*—Lisa M. Saldano
(74) *Attorney, Agent, or Firm*—Merchant & Gould, P.C.

(57) ABSTRACT

A method and a working machine (1) for the laying of wires (2) and/or infrastructures, wherein the steps of excavation (S) to execute an excavation (S) having a depth and width in accordance with the type of wire (2), of laying the wire (2) inside said excavation (S) and filling up said excavation (S) are executed without interruptions, through the use of just one working machine (1). The machine comprises a milling tool (12) to excavate a bench consolidating device (8), laying device (6) including a feeding duct (19), and filling device (7) including a tank (23) and injector device (24) to inject a semifluid material, for example concrete, into the bench. The injector device has a height control device (32) to control the level of the material to the bench

7 Claims, 2 Drawing Sheets

METHOD AND A WORKING MACHINE FOR THE LAYING CABLE, PIPES OR THE LIKE

Figure 1:
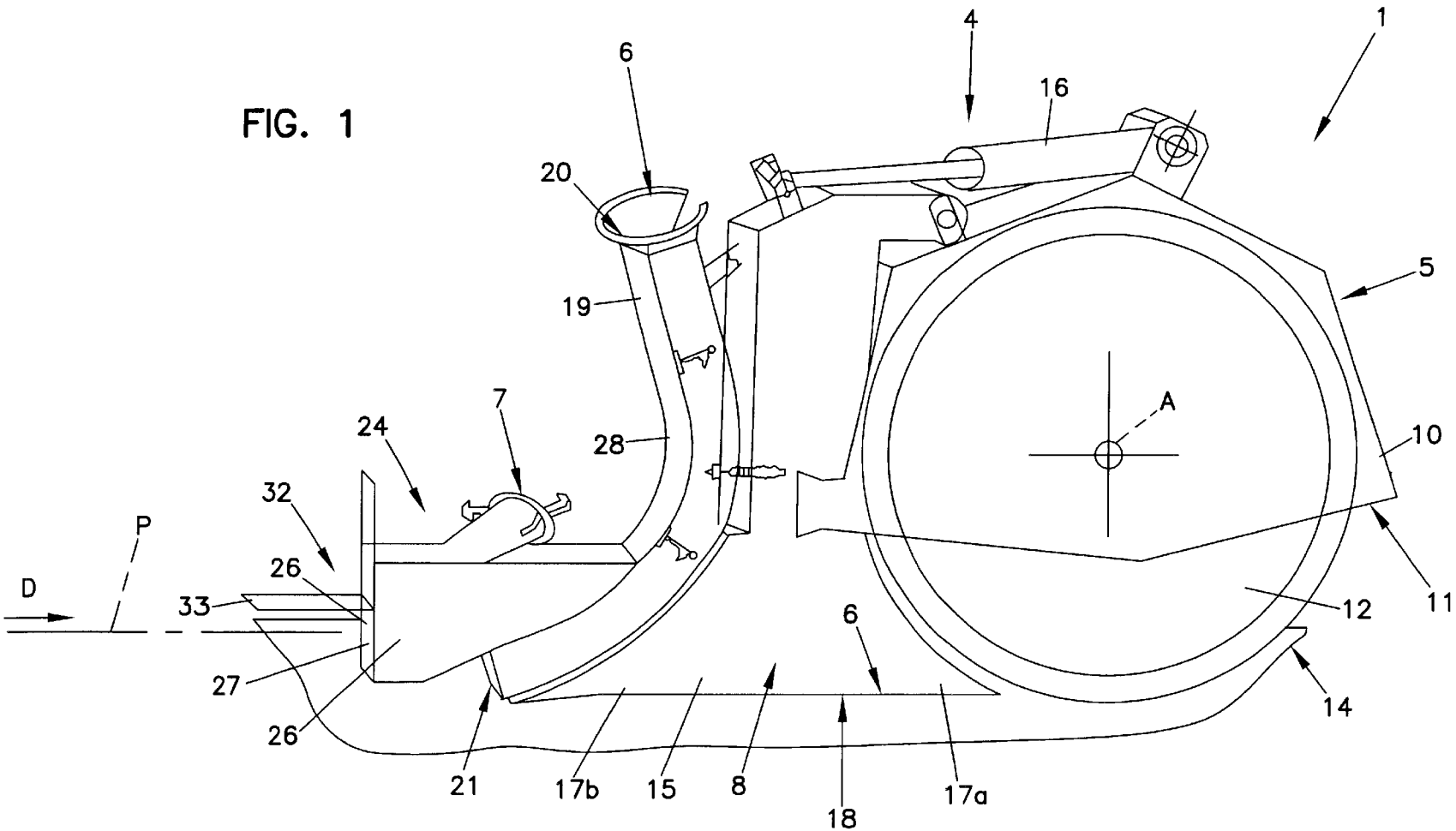

The present invention refers to a method for the laying of wires and/or infrastructures.

In particular, the present invention refers to a method for the laying of wires for telecommunications and/or electrical equipment, and for the laying of infrastructures of said equipment along the roads.

The discussion that follows will refer specifically to the laying of a wire, and all the descriptions about said laying will be fully applicable also to the infrastructures, without departing from the scope of the invention.

The known methods for the laying of wires comprise, usually, a step of digging to obtain an excavation with the depth and width in relation to the type of wire, a step of laying to lay the wire inside said excavation, and, finally, a step of filling up with earth the excavation itself.

The above mentioned three steps, beside being divided for portions of excavation having a defined length, so as to avoid the total obstruction of the road circulation, are separated one from the other and are executed in subsequent periods of time utilising excavation means as diggers, tri-functional excavators, catenaries and the like, at least a team of workers formed by 45 people, and autovehicles for the transportation of the waste materials to the dumping sites and of the inert materials for the filling up along the excavation.

From what it has been described, it appears evident that such a methodology, beside having very high costs considering both the significant number of people and of mechanical elements necessary and the long period of time necessary for closing the construction yard, shows further inconveniences such as, for example, the creation of significant obstruction of the road circulation.

The object of the present invention is to provide a method for the laying of wires, free of the above mentioned inconveniences.

According to the present invention, a method is provided to lay wires comprising a step of digging to obtain an excavation of predetermined depth and width along a defined portion of an excavation, a laying step to lay the wire inside said excavation, and a step for filling up the excavation itself, the method being characterised by the fact that all the three steps are executed without interruptions utilising just one working machine.

Further, the present invention refers to a working machine for the laying of wires.

According to the present invention a working machine is realised for the laying of wires, the machine being characterised by the fact of comprising a supporting frame which can be connected to drive means to move said frame along the length of a defined excavation, excavation milling means to obtain an excavation with predefined depth and width, laying means to lay the wire inside said excavation, and excavation filling up means; excavation means, laying means and filling up means are all supported by said frame.

Figure 3:
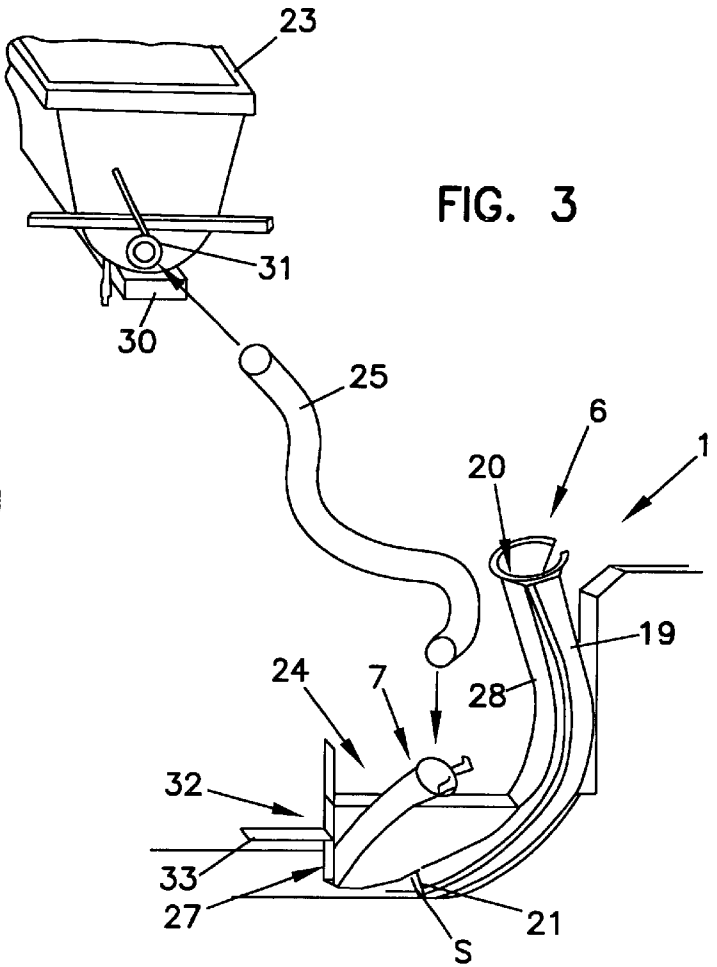
Figure 2:
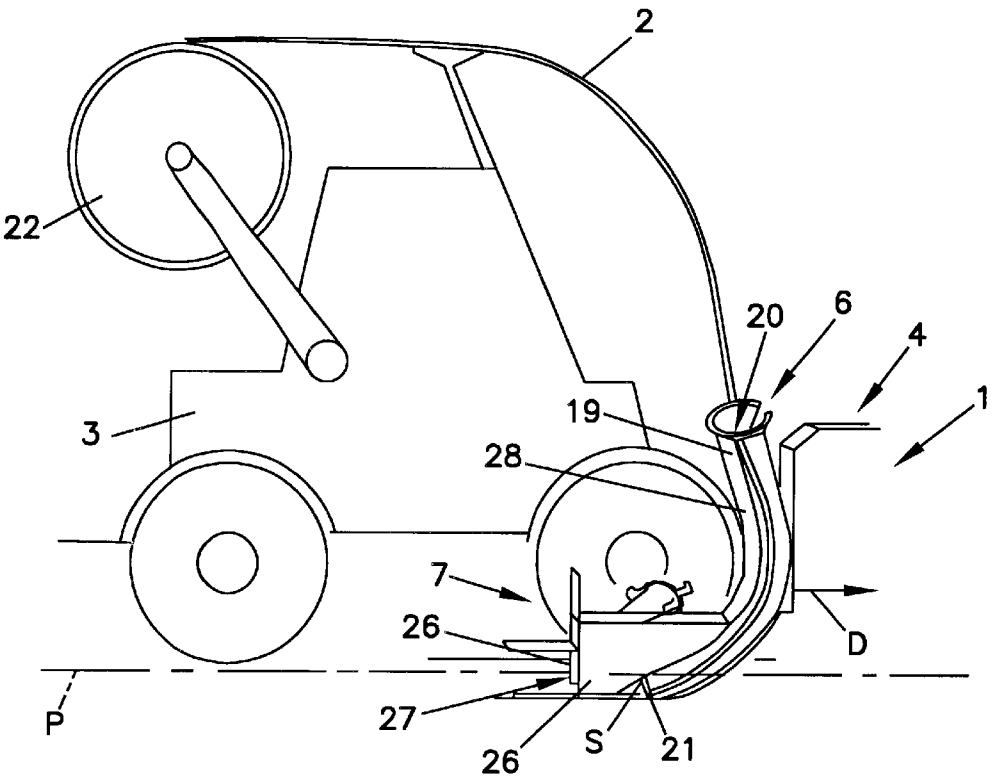

The invention will now be described by referring to the attached drawings, which explain a non limiting embodiment example, wherein:

FIG. 1 is a schematic view of a preferred embodiment of a machine for laying wires according to the present invention; and FIGS. 2 and 3 show, in a reduced scale and with parts removed for clarity sake, specific details of the machine of FIG. 1.

Referring to FIGS. 2 and 3, numeral 1 indicates a working machine for laying wires 2 and/or infrastructures to house said wires 2 along the road side.

The description that follows will refer to the laying of wires 2, and all the descriptions about said laying will be fully applicable also to the infrastructures, without departing from the scope of the invention.

The machine 1 can be connected to drive means 3 and can be moved along a defined portion P of an excavation and along a predefined advancement direction D, and comprises a supporting frame 4, and an excavation milling device 5, which is supported by the frame 4, and is suitable to execute an excavation S having a depth between 25 and 50 cm, so that there is no interference with other possible services already present, and a thickness comprised between 5 and 7 cm.

The machine 1 further comprises a laying device 6 to lay the wires 2 inside the excavation S, and a filling up device 7 of said excavation S capable to fill up the excavation S with semifluid material, such as, for example, substantially fluid plain concrete so as to fill immediately the microcracks and the microslides created by the passage of the excavation device 5. Further, the use of the plain concrete protects the integrity of the wire 2 and ensures the mechanical resistance to the solicitations caused by the traffic or by the maintenance of the road carpet.

The laying device 6 and the filling up device 7 are both supported by the frame 4, and are capable to operate together and simultaneously with the excavation device 5 during the advancement of the machine 1 along the length portion P.

The machine 1 comprises, finally, a device 8 of consolidation of the excavation S, said device is located in an intermediate position between the excavation device 5 and the laying device 6 to consolidate the excavation S during its realisation by avoiding landslides and loosening of the ground surrounding said excavation S.

The excavation device 5 comprises a protection screen 10 which defines a housing 11, and a circular miller 12, which is partially inserted inside said housing 11, and rotates around its horizontal axis A with a tangential speed, in the lower point of contact, directed along the direction D.

The miller 12 is provided with a plurality of teeth (not shown) uniformly distributed around the axis A along an annular outer periphery 14 and has a thickness, transversal to the axis A, which is substantially equal to the width of the excavation S and an operating depth of excavation variable between 25 and 50 cm.

The consolidation device 8 comprises a share 15, and drive means 16, which are hinged to the share 15 and to the top of the excavation screen 10, to locate the share 15 in a working position of consolidation, wherein the share 15 is adjacent to the miller 12.

In particular, the share 15 has, in a transversal position to the axis A, a width substantially equal to the width of the miller 12, and comprises two end bases 17*a* and 17*b* substantially triangular extending in opposite directions toward the miller 12 and toward the filling up device 7, wherein the base 17*a* surrounds partially, in the consolidation working position, the periphery 14 and stays substantially tangent to said teeth.

The bases 17*a* and 17*b* are delimited, in the lower part, by a flat horizontal surface 18, which extends along a horizontal plane tangent to the lower end of the miller 12, and, therefore, said surface can slide substantially in contact with the bottom of the excavation S in order to clean the bottom of said excavation.

The laying device 6 comprises a feeding duct 19, that is located close to the share 15, and is provided with an upper entry 20 and a lower exit 21. The entry 20 is substantially located on the opposite side of the excavation S to receive the wire 2 from a reel 22 supported by the means 3, while the exit 21 is located on the opposite side of the miller 12, and is located substantially tangent to the surface 18.

The duct 19 is suitable to be entirely engaged in a sliding way by the wire 2, which can be fed into the excavation S through the exit 21 in an opposite direction with respect to the direction D.

According to FIG. 3, the filling up device 7 comprises a mixture tank 23 for said plain concrete, said tank is connected to the frame 4 and is provided with a mixture device (known and not illustrated), an injector 24, placed closed to the duct 19, to inject the concrete inside the excavation S over the wire 2, and a connecting duct 25 of the injector 24 to the tank 23.

The tank 23 is supported by a beam 30 which is part of the frame 4, and comprises a concrete exit valve 31 connected to the duct 25. The injector 24 comprises two lateral guides 26, that are located at a relative distance, transversal to the axis A, substantially equal to the thickness of the miller 12, and define an exit opening 27 for the concrete located in correspondence to the exit 21.

Further, the injector 24 comprises a curved wall 28, that is rigidly connected to the guides 26, and is connected, in a releasable way, to the duct 19. In particular, the wall 28 defines part of the duct 19, and once it is removed from the its assembled position allows the inspection of said duct 19.

The injector 24 comprises, finally, a control device 32 suitable to control the level of the concrete inside the excavation S, and said control device comprises a tile 33, that is substantially parallel to the surface 18, and is coupled in a sliding way to the guides 26 in order to slide, with respect to the exit 27, transversally to the direction D. The device 32 comprises, further, a level sensor (known and not illustrated) suitable to sense the position of the tile 33, and coupled to the valve 31 to control the exit of concrete from the tank 23.

During use, the machine 1 is located in correspondence of the beginning of the length P, that, in urban areas, will run substantially close to the sidewalks, while in the extra-urban areas, will run adjacent to the road carpet close to the shoulder, or in the roadway.

When the concrete has been mixed inside the tank 23, the miller 12 will be started, which, by being pushed forward by the means 3 along the length P and by being simultaneously rotated around the axis A, will dig the ground at the desired depth and will execute the excavation S.

The share 15 is lowered in the excavation only at a later time, because it will be first necessary to obtain a portion of the excavation S to allow the introduction of the bases 17*a* and 17*b* into said excavation S.

Once the share 15 is located in its working consolidation position, the machine 1 starts to advance along the length P, and, while the miller 12 executes the excavation S, the wire 2 is fed inside said excavation S and at the same time said wire is covered by the concrete injected by the injector 24.

The danger of landslides or land sinking is prevented by the presence of the share 15, that immediately occupies the space of the excavation S being freed by the miller 12, and as previously described, said share cleans the bottom of said excavation S from the debris and guarantees a perfect support plane for the wire 2.

During the advancement of the machine 1 along the length P, the filling up device 7 feeds continuously the concrete inside the excavation S, through the injector 24, and the device 32 control the height of said concrete inside said excavation S. thus allowing the execution of a homogeneous and free from undulations filling up surface. The height of the concrete inside the excavation S is determined by the above mentioned sensor and is controlled by said sensor, through the adjustment of the concrete flow through the valve 31.

The excavation, the laying of the wire 2 and the filling up of the excavation S are executed without interruptions, using only the machine 1 and therefore allowing both a significant saving of man power and of other construction means, and also of time, since the advancement speed of the machine 1, and consequently the speed of laying completion is surely higher than the speed presently obtained by traditional methods and machines.

What is claimed is:

1. A working machine for laying wires, the machine comprising:

a supporting frame which can be connected to drive means suitable to move said frame along a predefined length of an excavation, excavation means suitable to execute said excavation, laying means having a feeding duct to lay wire inside said excavation, filling up means to fill up said excavation; and consolidation means of said excavation, which are located in an intermediate position between said excavation means and said laving means in order to consolidate the just executed excavation;

wherein the excavation means, the laying means and the filling up means are all supported by said frame, and wherein an excavation width of the excavation is substantially comprised between 5 and 7 cm and a working depth of the excavation is substantially variable between 25 and 50 cm; and said feeding duct comprising a closing wall which can be disengaged from the duct in order to allow inspection of the duct.

2. A machine according to claim 1, wherein said excavation means comprises a milling tool with a tangential speed, at a lower contact point, directed along an advancing direction of said drive means; said tool having an excavation width substantially equal to the width of said excavation.

3. A machine according to claim 2, wherein the feeding duct of said wire defines an exit for said wire; and said exit defines an exit direction opposite to said advancing direction.

4. A machine according to claim 3, wherein said filling up means comprise a mixture tank of semifluid material for filling up of the excavation, and an injector device to inject said semifluid material inside the excavation.

5. A machine according to claim 4, wherein the injector device comprises an exit opening for the semifluid material located substantially at the exit of the wire, and a duct connecting the exit opening with the mixture tank; wherein said tank is connected to said frame.

6. A machine according to claim 5, wherein said injector device comprises control means to adjust a height of the semifluid material inside the excavation; and said control means are associated to said exit opening.

7. A machine according to claim 1, wherein said consolidation means comprise a ploughshare which has two opposite ends, and a drive device of the ploughshare hinged to said excavation means to locate the ploughshare in a working position of consolidation, wherein one of said ends is located substantially in a tangential position with respect to said excavations means.

* * * * *